US011672322B1

(12) United States Patent
Mulhearn et al.

(10) Patent No.: US 11,672,322 B1
(45) Date of Patent: Jun. 13, 2023

(54) TOY CARRYING HARNESS ASSEMBLY

(71) Applicants: Meredith Mulhearn, Ridgefield, CT (US); Charlotte Mulhearn, Ridgefield, CT (US)

(72) Inventors: Meredith Mulhearn, Ridgefield, CT (US); Charlotte Mulhearn, Ridgefield, CT (US)

( * ) Notice: Subject to any disclaimer, the term of this patent is extended or adjusted under 35 U.S.C. 154(b) by 175 days.

(21) Appl. No.: 17/344,556

(22) Filed: Jun. 10, 2021

Related U.S. Application Data

(60) Provisional application No. 63/037,045, filed on Jun. 10, 2020.

(51) Int. Cl.
*A45F 3/04* (2006.01)

(52) U.S. Cl.
CPC ..... *A45F 3/04* (2013.01); *A45F 2003/045* (2013.01); *A45F 2200/05* (2013.01)

(58) Field of Classification Search
CPC ..... A45F 3/042; A45F 3/04; A45F 2003/045
USPC ..... 224/646, 623, 160; D3/216
See application file for complete search history.

(56) References Cited

U.S. PATENT DOCUMENTS 4,428,514 A 1/1984 Elf
1,986,458 A 1/1991 Linday
5,016,797 A 5/1991 Rowledge
5,205,450 A 4/1993 Derosier
5,205,451 A 4/1993 Manzer
D352,165 S * 11/1994 Covertson ..... 224/643
5,490,620 A 2/1996 Bergqvist
D370,090 S * 5/1996 Coggins ..... D3/214
5,586,703 A * 12/1996 Radar ..... A45F 3/04 224/601
5,678,739 A 10/1997 Darling et al.
5,799,851 A * 9/1998 Wulf ..... A45F 3/047 224/582
6,336,576 B1 * 1/2002 Easter ..... F41C 33/007 224/582
6,345,751 B1 * 2/2002 Elliot ..... A45F 3/04 224/640
6,402,003 B1 * 6/2002 Jackson ..... A45F 3/042 224/640
6,409,060 B2 6/2002 Donine
6,510,974 B2 * 1/2003 Willingham ..... A45C 7/0095 D3/217
6,619,519 B1 * 9/2003 Nix ..... A45C 7/0086 224/664

(Continued)

FOREIGN PATENT DOCUMENTS

JP 3146658 U 11/2008

*Primary Examiner* — Justin M Larson
(74) *Attorney, Agent, or Firm* — John Rizvi; John Rizvi, P.A.—The Patent Professor®

(57) ABSTRACT

A toy carrying harness assembly suitable to be worn by a child to securely hold and carry at least one toy may include a chest panel positional over the chest of the child. A back panel may be positional over the back of the child. At least one base strap may extend from the chest panel to the back panel. At least one panel strap may extend from the chest panel. A pair of shoulder straps may extend from the at least one panel strap to the back panel. The pair of shoulder straps may be securable over the shoulders of the child. At least one toy securing strap may be carried by the chest panel. The at least one toy securing strap may be selectively fastenable around the toy to secure the toy to the chest panel.

20 Claims, 6 Drawing Sheets

(56) References Cited

U.S. PATENT DOCUMENTS 6,672,493 B1 1/2004 Fair et al.
6,866,173 B2 * 3/2005 Haber ..... A47D 13/025 224/160
6,932,256 B2 * 8/2005 Hale ..... A45F 3/08 224/648
D623,403 S * 9/2010 Sammons ..... D3/215
8,636,181 B2 1/2014 Gunter et al.
8,960,511 B2 * 2/2015 Shepherd ..... A45F 3/14 442/205
9,901,162 B1 * 2/2018 Chang ..... A45F 3/047
10,154,724 B2 * 12/2018 Boino ..... A45F 5/00
D875,386 S * 2/2020 Lee ..... D3/217
11,044,986 B2 * 6/2021 Thomas ..... A45F 5/02
D953,736 S * 6/2022 Mckinney ..... D3/217
D974,027 S * 1/2023 Li ..... D3/216
11,547,200 B2 * 1/2023 Revels ..... A45F 3/04
2002/0088830 A1 * 7/2002 Rose ..... A45C 15/00 224/652
2002/0185508 A1 * 12/2002 Clark ..... A45F 3/04 224/652
2005/0045687 A1 * 3/2005 Willows ..... A41D 13/01 224/637
2009/0095784 A1 * 4/2009 Enriquez ..... A45F 3/00 224/650
2009/0108036 A1 * 4/2009 Moore ..... A45C 13/02 224/153
2010/0282808 A1 11/2010 Debnam et al.
2011/0036877 A1 * 2/2011 Boino ..... A45F 5/00 224/262
2011/0309122 A1 * 12/2011 Sternlight ..... A45F 4/02 224/576
2014/0131401 A1 * 5/2014 Workman ..... A47D 13/025 224/160
2015/0282638 A1 * 10/2015 Workman ..... A47D 13/025 224/160
2015/0289629 A1 * 10/2015 Nakamura ..... A45C 13/08 24/3.1
2019/0159579 A1 * 5/2019 Picking ..... A45F 5/021
2021/0085061 A1 * 3/2021 Souza ..... A45F 3/047

* cited by examiner

TOY CARRYING HARNESS ASSEMBLY

CROSS-REFERENCE TO RELATED APPLICATIONS

This application claims the benefit of U.S. Provisional Patent Application Ser. No. 63/037,045, filed on Jun. 10, 2020, which is incorporated by reference herein in its entirety.

FIELD OF THE INVENTION

The present invention relates generally to harnesses, and more particularly, to a toy carrying harness assembly which is suitable for deployment on a child to secure and carry at least one toy in such a manner that the risk of loss or misplacement of the toy while being carried is prevented or minimized.

BACKGROUND OF THE INVENTION

Toddlers and small children require large periods of time and intensive attention. Toys are therefore a useful and productive way to engage the attention of a child for long periods of time. Toys also are indispensable to the mental, emotional and educational development of a child.

Toddlers and small children frequently play with various types of toys, which take many different forms. For example, some types of toys may enable children to learn different sizes, shapes, and textures. Other types of toys, particularly for older children, may resemble cars, trucks, houses, boats, airplanes, and the like to familiarize children with adult activities. Girls may play with dolls to become familiar with the child rearing process, whereas boys may play with simulated hammers, screwdrivers, saws and other tools to familiarize them with construction projects and the like.

Stuffed toys are popular with toddlers and small children. A stuffed toy includes an outer fabric material which forms a cover filled with a flexible stuffing material. The cover is typically shaped in the form of a bear, snake or other animal. Stuffed toys may be otherwise known as plush toys or stuffed animals. Fabric materials which form the cover may include plain cloth, terrycloth or other soft material. The flexible stuffing material may include synthetic fiber, batting, cotton, straw, wool or plastic pellets, beans or beads.

Stuffed toys may resemble animals, legendary creatures, cartoon characters or objects such as balloons or airplanes. They are often used to comfort children and may be collected or given as gifts.

After a prolonged period of playing, children frequently become attached to one or more of their toys. This is particularly common in the case of stuffed toys. Children may not only sleep with a favorite stuffed toy but also insist on carrying the toy when the parent or caregiver takes the child to preschool or on errands. In such cases, the toy may be carried by the child or caregiver or in a purse, bag, sack or other container which the caregiver carries.

One of the limitations of conventional methods of carrying stuffed toys or other types of toys away from home is that the toys may inadvertently be left at a location at which the child played with the toy. Alternatively, the toy may be dropped by the child or may fall from the purse, bag, sack or other container in which the toy is carried.

Accordingly, there is need for a solution to one or more of the aforementioned shortcomings in the art.

SUMMARY OF THE INVENTION

The present invention is directed to a toy carrying harness assembly which is suitable to be worn by a child to secure and carry a toy in such a manner that the risk of loss or misplacement of the toy while being carried is prevented or minimized. The toy carrying harness assembly may include a chest panel which is positional over the chest and a back panel which is positional over the back on the torso of the child. At least one base strap may extend and attach the chest panel to the back panel. At least one panel strap may extend from the chest panel. A pair of shoulder straps may extend from the panel strap to the back panel. The shoulder straps may be securable over the respective shoulders of the child. At least one toy securing strap may be provided on the chest panel. The at least one toy securing strap may be selectively fastenable around the toy to secure the toy to the chest panel.

In one embodiment of the invention, a toy carrying harness assembly may include a chest panel which is positional over the chest of the child. The chest panel may be configured to secure at least one toy to be carried. A back panel may be positional over the back of the child. At least one base strap may attach the chest panel to the back panel. A pair of shoulder straps may extend from the back panel. The shoulder straps may be attached to a panel strap which extends from the chest panel. At least one toy securing strap may extend from the chest panel. The toy securing strap may be selectively securable around the toy to be carried to secure the toy against the front panel.

The toy carrying harness assembly may be donned by the child for use by placing the shoulder straps over the respective shoulders of the child. The base strap may be extended around the torso of the child and fastened. The tightness of the shoulder straps may be selectively adjusted to achieve a snug fit of the toy carrying harness assembly on the child. The toy may be secured to the chest panel by extending the toy securing straps around the toy and securing the toy securing straps. The toy securing straps may be tightened to achieve a secure fit of the toy against the chest panel.

In a second aspect, the at least one base strap may include at least one base strap buckle to facilitate selective fastening and unfastening of the base strap.

In another aspect, the at least one panel strap may include at least one panel strap buckle to facilitate selective fastening and unfastening of the panel strap.

In another aspect, the at least one base strap buckle and the at least one panel strap buckle may include a quick-disconnect connector.

In another aspect, each shoulder strap may include at least one shoulder strap adjuster to facilitate adjustment in the length of each shoulder strap.

In another aspect, the at least one toy securing strap may include at least one toy strap adjuster to facilitate adjustment of the tightness of the toy securing strap against the toy and the toy against the chest panel.

In another aspect, the at least one toy securing strap may include a plurality of toy securing straps.

In another aspect, the chest panel may have a pair of chest panel side edges, a chest panel bottom edge, a chest panel top edge, a chest panel front surface and a chest panel rear surface.

In another aspect, the at least one toy securing strap may be configured to secure the toy to the chest panel front surface of the chest panel.

In another aspect, the back panel may have a pair of back panel side edges, a back panel bottom edge, a back panel top edge, a back panel front surface and a back panel rear surface.

In another aspect, the at least one base strap may extend from the respective back panel side edges of the back panel.

In another aspect, at least one logo may be provided on the back panel rear surface of the back panel.

In another aspect, the base strap may include a tab strap segment and a receptacle strap segment which extend from the back panel and a base strap buckle having a buckle tab on the tab strap segment and a buckle receptacle on the receptacle strap segment, and the buckle tab may be inserted in the buckle receptacle of the base strap buckle to detachably secure the tab strap segment and the buckle strap segment to each other.

In another aspect, the panel strap may include a tab strap segment and a receptacle strap segment which extend from opposite sides of the chest panel and a panel strap buckle having a buckle tab on the tab strap segment and a buckle receptacle on the receptacle strap segment, and the buckle tab may be inserted in the buckle receptacle of the base strap buckle to detachably secure the tab strap segment and the buckle strap segment to each other.

In another aspect, the chest panel and the back panel may be waterproof or water-resistant.

In another aspect, the toy carrying harness assembly may be mildew resistant.

In another aspect, the components of the toy carrying harness assembly may be fabricated in various sizes to accommodate children of different sizes and ages.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
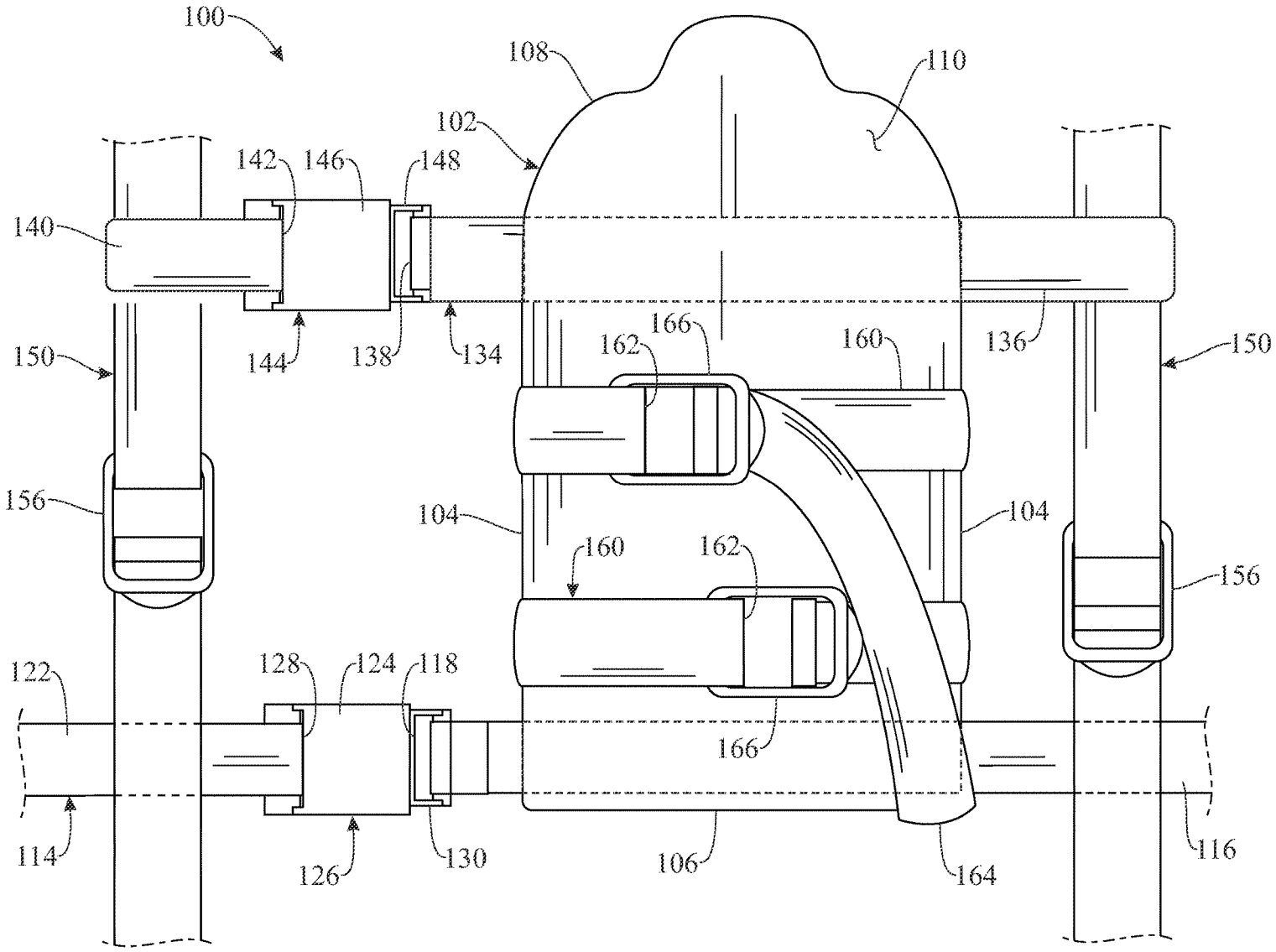
FIG. 1 presents a partial front elevation of one illustrative embodiment of a toy carrying harness assembly in an unfastened configuration, in accordance with the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed to a toy carrying harness assembly which is dimensioned to be worn by a child and to secure and carry a toy in such a manner that the risk of loss or misplacement of the toy is prevented or minimized.

Referring to the figures, a toy carrying harness assembly, hereinafter assembly 100, is illustrated in accordance with an illustrative embodiment of the present invention. As shown for instance in FIG. 6, the assembly 100 may include a chest panel 102 and a back panel 172. At least one toy securing strap 160 is provided on the chest panel 102. A base strap 114 in at least one embodiment attaches the back panel 172 to the chest panel 102. A panel strap 134 may extend from the chest panel 102. A pair of shoulder straps 150 may extend from the back panel 172 to the panel strap 134. In at least some embodiments, each shoulder strap 150 is stitched and/or otherwise attached to the panel strap 134.

In at least one embodiment, the assembly 100 is deployed on a wearer 190, such as a toddler or small child, to securely retain at least one toy 168 thereto. Accordingly, the shoulder straps 150 may be placed over the respective shoulders 192 of the wearer 190 with the chest panel 102 disposed over the chest 196 and the back panel 172 disposed over the back 198 on the torso 194 of the wearer 190. The panel strap 134 may be fastened to secure the shoulder straps 150 in place. The toy 168 may be secured to the chest panel 102 by extending the toy securing strap or straps 160 around the toy 168 and securing or tightening the toy securing straps 160. The toy 168 may thus be securely fastened to the chest panel 102 and carried on the person of the wearer 190 to prevent or minimize the possibility that the toy 168 will be lost or misplaced.

Figure 3:
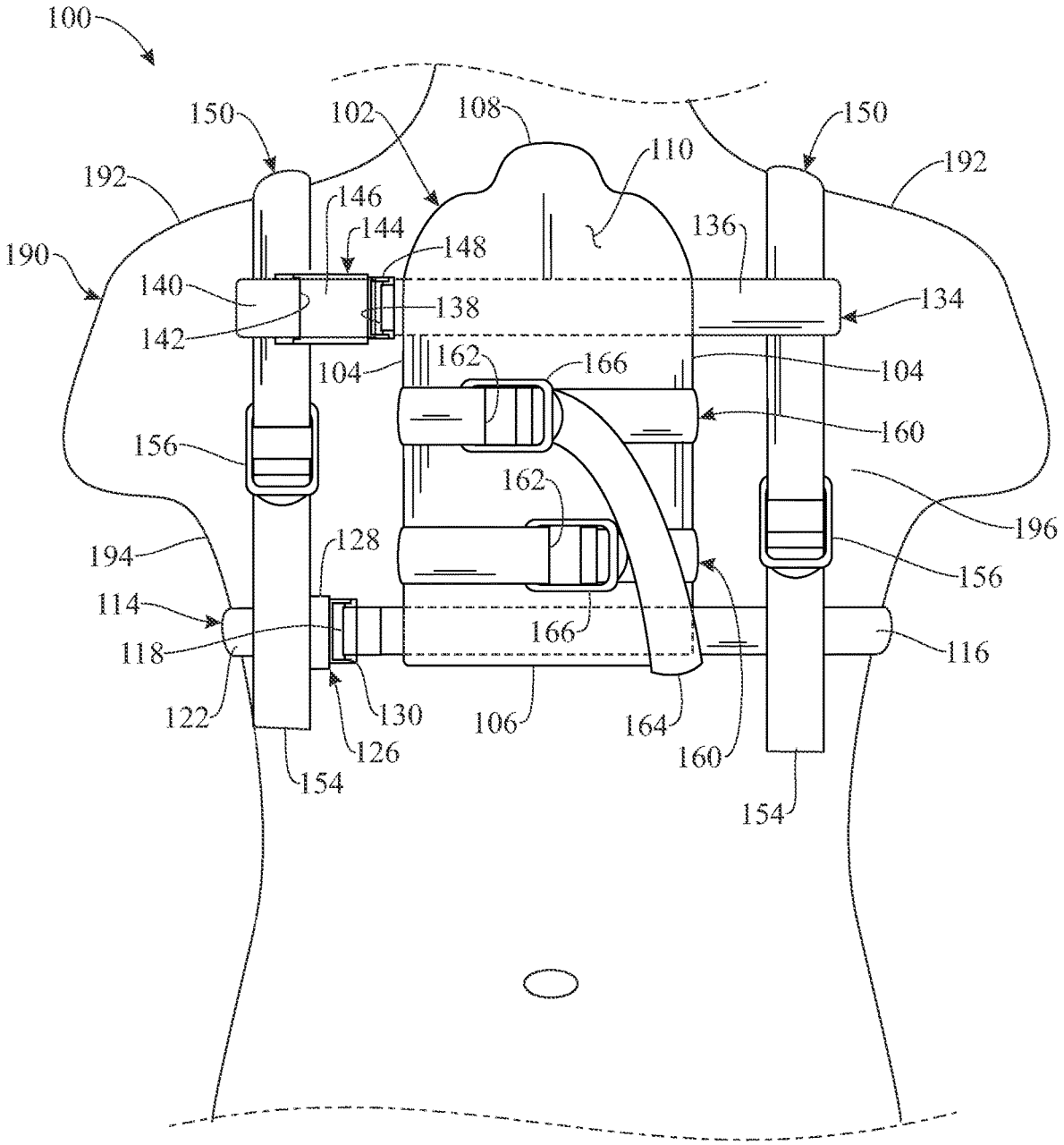
FIG. 3 presents a front elevation of the toy carrying harness assembly of FIG. 1 fastened in place on a wearer, in accordance with the present invention.

As illustrated in FIGS. 1 and 3, in some embodiments, the chest panel 102 may have a pair of chest panel side edges 104, a chest panel bottom edge 106 and a chest panel top edge 108. The chest panel 102 may be generally elongated from the chest panel bottom edge 106 to the chest panel top edge 108. A chest panel front surface 110 and a chest panel rear surface 112 may be bounded by the chest panel side edges 104, the chest panel bottom edge 106 and the chest panel top edge 108. In other embodiments, the chest panel 102 may have any of a variety of alternative shapes.

Figure 2:
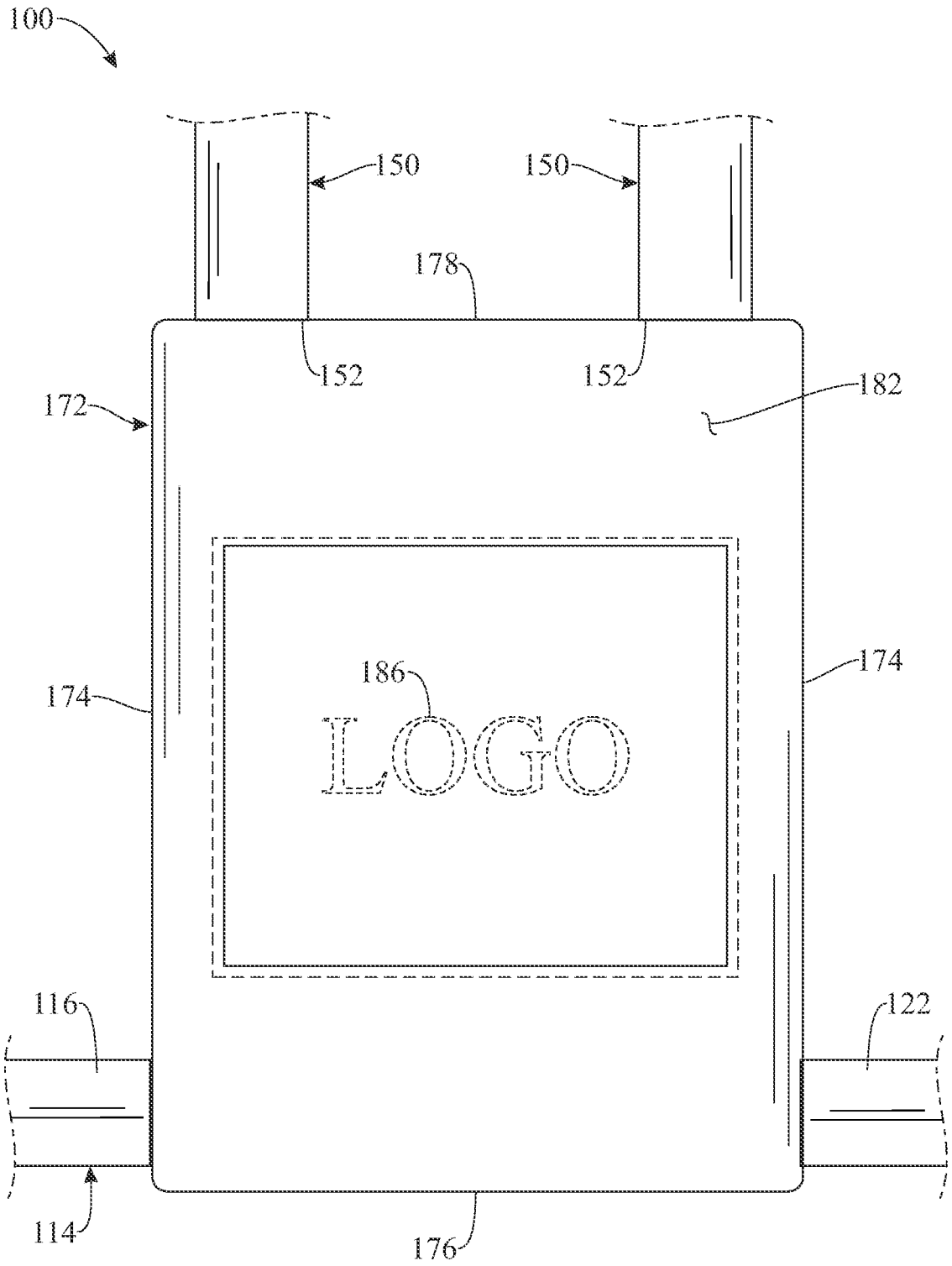
FIG. 2 presents a partial rear elevation of one illustrative embodiment of a toy carrying harness assembly having a logo on a back panel, in accordance with the present invention.
Figure 4:
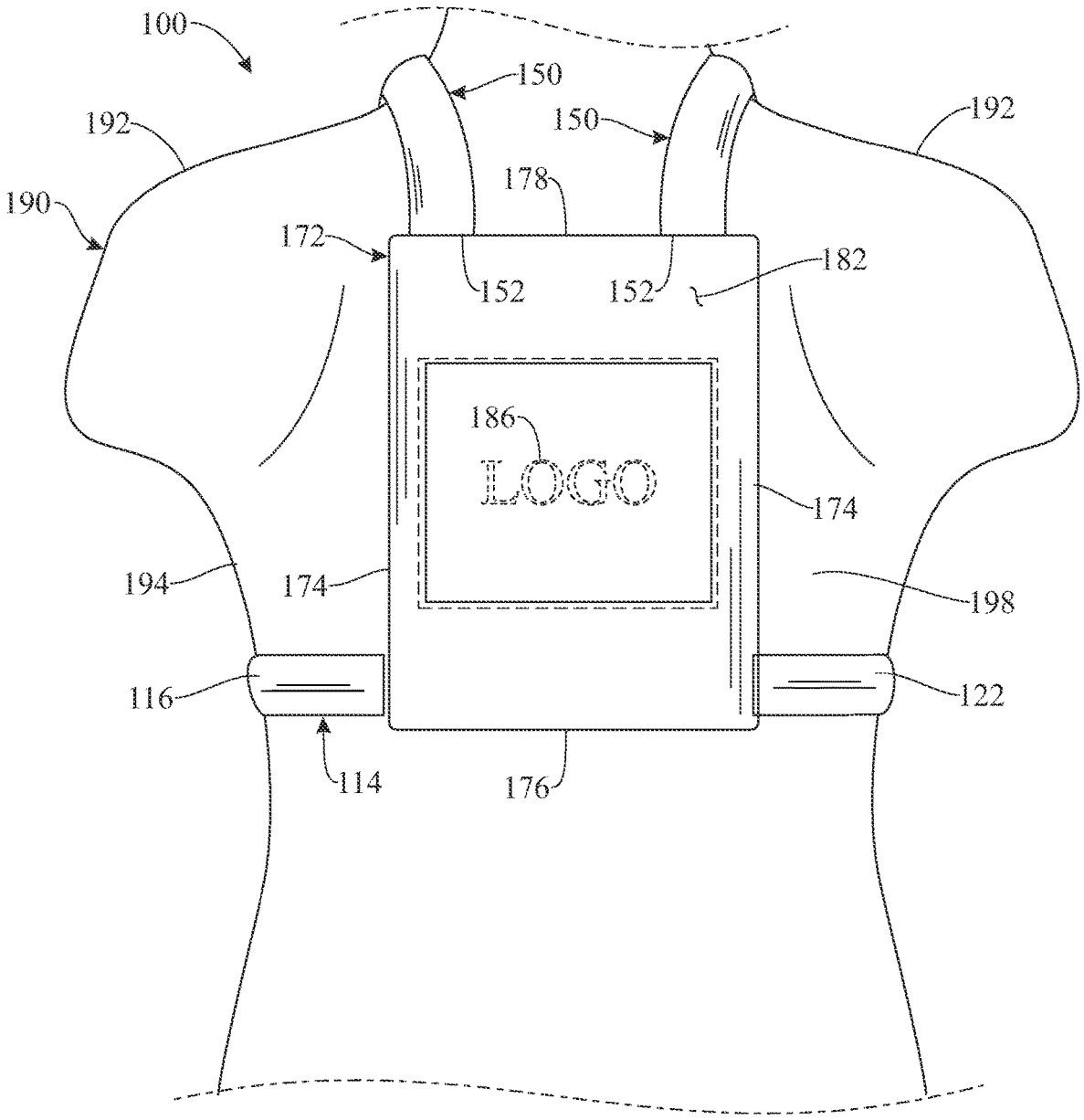
FIG. 4 presents a rear elevation of the toy carrying harness assembly of FIG. 2 fastened in place on the wearer, in accordance with the present invention.
Figure 6:
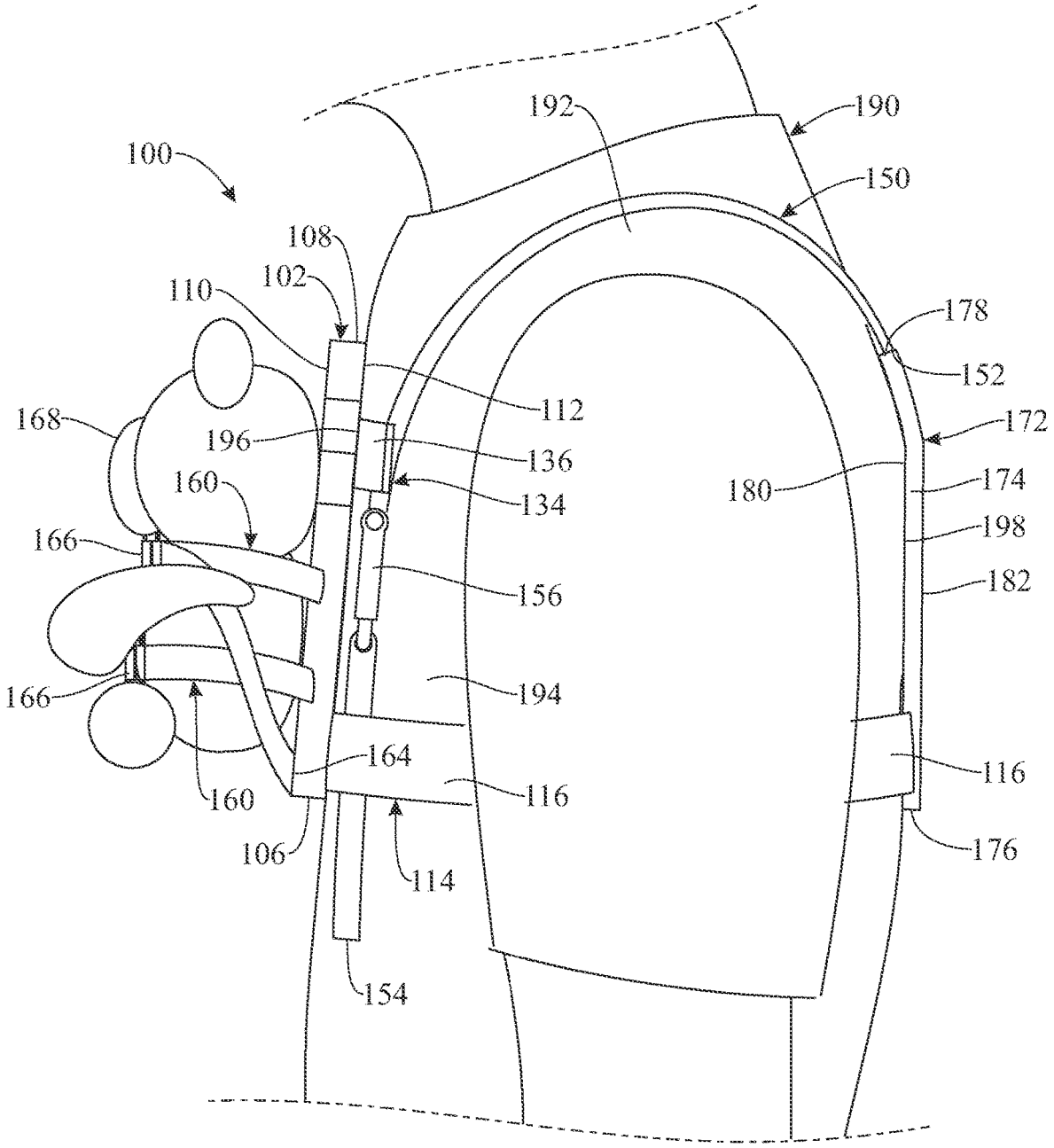
FIG. 6 presents a left side elevation of the toy carrying harness assembly fastened in place on the wearer and having a stuffed toy secured on the chest panel as in FIG. 5, in accordance with the present invention.

As illustrated in FIGS. 2 and 4, in some embodiments, the back panel 172 may have a pair of back panel side edges 174, a back panel bottom edge 176 and a back panel top edge 178. A back panel front surface 180 and a back panel rear surface 182, as shown in FIG. 6, may be bounded by back panel side edges 174, the back panel bottom edge 176 and the back panel top edge 178. In at least some embodiments, a back panel 172 may comprise any of a variety of alternative geometric shapes. In at least one embodiment, one or more logo 186 such as a company, team or sports emblem, for example and without limitation, may be printed, stamped and/or otherwise provided on the back panel rear surface 182 of the back panel 172.

In one embodiment, the base strap 114 may include a base strap buckle 126. The base strap buckle 126 may facilitate fastening of the base strap 114 around the torso 194 of the wearer 190. The base strap 114 may have a tab strap segment 116 and a receptacle strap segment 122. As illustrated in FIGS. 2 and 4, in some embodiments, the tab strap segment 116 and the receptacle strap segment 122 may extend from the respective back panel side edges 174 of the back panel 172. As illustrated in FIG. 1, the tab strap segment 116 may have a tab end 118 and the receptacle strap segment 122 may have a receptacle end 124. A buckle receptacle 128 may terminate the receptacle end 124 of the receptacle strap segment 122. A buckle tab 130 may terminate the tab end 118 of the tab strap segment 116.

In one further embodiment, the base strap buckle 126 may comprise a quick-disconnect type buckle. Accordingly, the buckle tab 130 may be releasably inserted in the buckle receptacle 128 of the base strap buckle 126 to removably fasten the base strap 114. In some embodiments, the receptacle strap segment 122 may be selectively slidable with respect to the buckle receptacle 128 to facilitate adjustment in the length of the base strap 114.

In yet another embodiment, the panel strap 134 may include a panel strap buckle 144. The panel strap buckle 144 may facilitate fastening of the panel strap 134 to secure the shoulder straps 150 to each other as the assembly 100 is fastened on the wearer 190. The panel strap 134 may have a tab strap segment 136 and a receptacle strap segment 140. In some embodiments, the tab strap segment 136 and the receptacle strap segment 140 may extend from the respective chest panel side edges 104 of the chest panel 102. As illustrated in FIG. 1, the tab strap segment 136 may have a tab end 138 and the receptacle strap segment 140 may have a receptacle end 142. A buckle receptacle 146 of the panel strap buckle 144 may terminate the receptacle end 142 of the receptacle strap segment 140. A buckle tab 148 of the panel strap buckle 144 may terminate the tab end 138 of the tab strap segment 136.

Each shoulder strap 150 may have a rear panel attachment end 152, as shown in FIGS. 2 and 4, and a free strap adjusting end 154, as shown in FIG. 3, opposite the rear panel attachment end 152. In some embodiments, the rear panel attachment end 152 may be attached to the back panel top edge 178 of the back panel 172, as illustrated in FIGS. 2 and 4. A shoulder strap adjuster 156 may be provided in each shoulder strap 150. Each shoulder strap adjuster 156 may facilitate length adjustment of the corresponding shoulder strap 150 to achieve a selected snug fit or tightness of the shoulder straps 150 on the shoulders 192 of the wearer 190.

Figure 5:
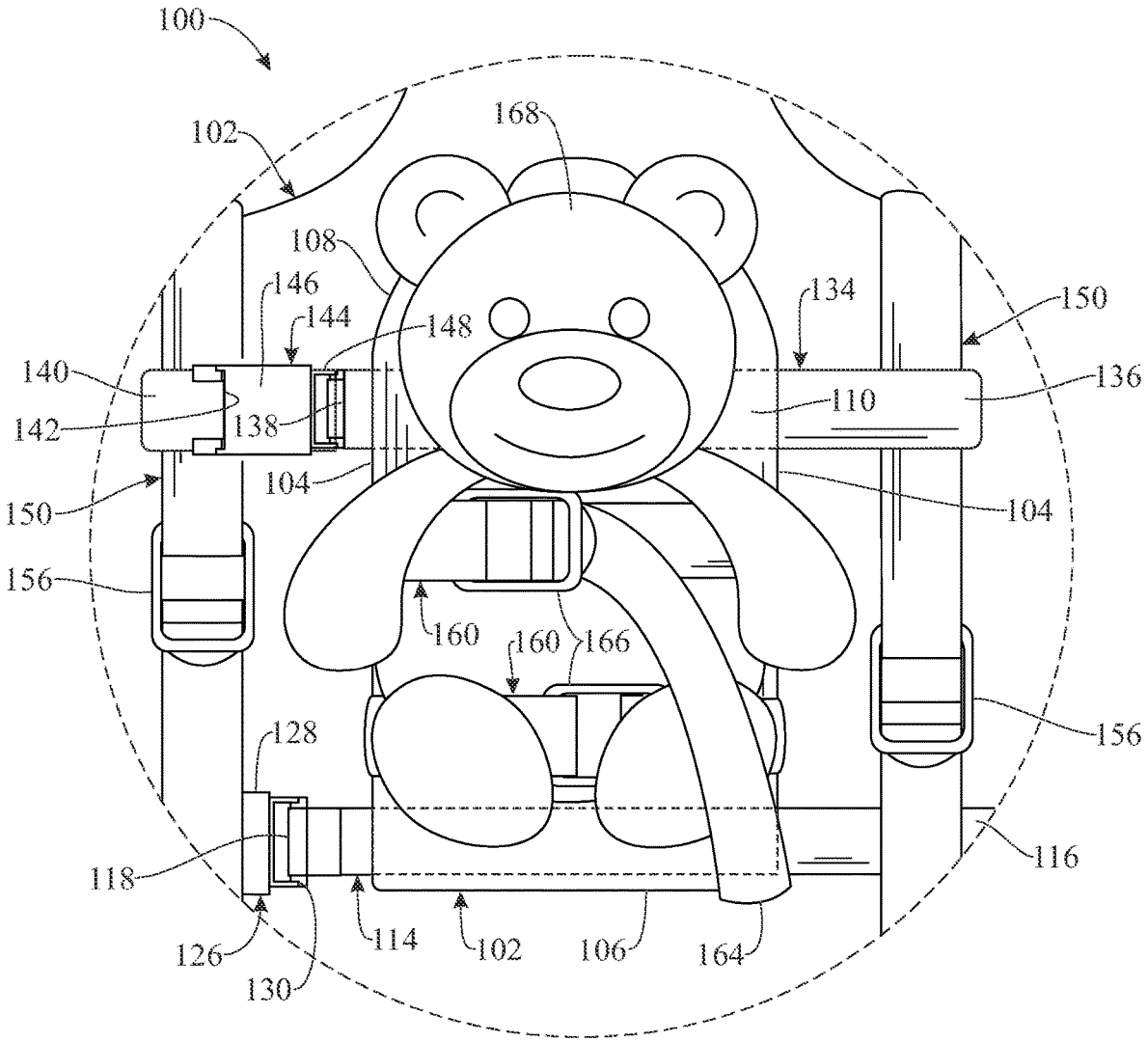
FIG. 5 presents a front elevation of the toy carrying harness assembly fastened in place on the wearer as in FIG. 3, having a stuffed toy secured on the chest panel, in accordance with the present invention.

As illustrated in FIGS. 5 and 6, the toy securing straps 160 may be configured to secure the toy 168 against the chest panel front surface 110 of the chest panel 102. Each toy securing strap 160 may include a tab strap segment 136 and a receptacle strap segment 140 which may extend beyond the respective chest panel side edges 104 of the chest panel 102. The tab strap segment 136 and the receptacle strap segment 140 may be attached to the chest panel rear surface 112, or alternatively, to the respective chest panel side edges 104 of the chest panel 102 using stitching, mechanical fasteners and/or other suitable attachment technique.

In some embodiments, each toy securing strap 160 may be selectively length-adjustable. Accordingly, a toy strap adjuster 166 may be provided in the toy securing strap 160. The toy strap adjuster 166 may facilitate length adjustment of the toy securing strap 160 to achieve a snug fit of the toy 168 against the chest panel 102. Each toy strap adjuster 166 may be standard or conventional, with each toy securing strap 160 typically having a fixed strap end 162 attached to the toy strap adjuster 166 and a free strap end 164 threaded through the strap adjuster 166, as shown in FIG. 1. The free strap end 164 may be selectively pulled to thread the toy securing strap 160 through the corresponding toy strap adjuster 166 and tighten the toy securing straps 160 against the toy 168.

In one application, the assembly 100 may be donned by a wearer 190 such as a toddler or small child to securely hold at least one toy 168 such as a stuffed toy, for example and without limitation, as illustrated in FIGS. 5 and 6. The assembly 100 may prevent or minimize the risk that the toy 168 is inadvertently lost or misplaced, particularly under circumstances in which the wearer 190 carries the toy 168 as a caregiver takes the wearer 190 away from home. Accordingly, the shoulder straps 150 may be placed over the respective shoulders 192 of the wearer 190, as illustrated in FIGS. 3 and 6. The lengths of the shoulder straps 150 may be selected, by sliding the shoulder straps 150 through the respective shoulder strap adjusters 156. to tighten the shoulder straps 150 against the respective shoulders 192 of the wearer 190 in order to achieve an optimum fit. The panel strap 134 may be fastened by inserting the buckle tab 148 into the buckle receptacle 146 of the panel strap buckle 144. The base strap 114 may in like manner be fastened around the torso 194 of the wearer 190 by inserting the buckle tab 130 into the buckle receptacle 128 of the base strap buckle 126.

The toy 168 may be secured to the chest panel 102 by initially placing the toy 168 against the chest panel front surface 110 of the chest panel 102. The toy securing straps 160 may be extended around the toy 168 and threaded through the respective toy strap adjusters 166. The toy securing straps 160 may continue to be slid through the toy strap adjusters 166 in the tightening direction until a snug fit of the toy securing straps 160 against the toy 168 and the toy 168 against the chest panel 102 is achieved.

In the event that the wearer 190 desires to play with the toy 168, the toy securing straps 160 may be loosened, such as by pulling the toy securing straps 160 in the loosening direction through the respective toy strap adjusters 166. The toy 168 can then be removed from between the loosened toy securing straps 160 and the chest panel 102. After the child has finished playing with the toy 168, the toy 168 can again be secured on the chest panel 102, as was heretofore described.

After use, the toy 168 can be removed from the chest panel 102 by loosening the shoulder straps 150, as was heretofore described. The assembly 100 can be removed from the wearer 190 by loosening the shoulder straps 150 via the respective shoulder strap adjusters 156. The panel strap 134 may be unfastened by releasing the panel strap buckle 144. The base strap 114 may be unfastened by releasing the base strap buckle 126. The unfastened assembly 100 can then be removed from the wearer 190 for later use.

It will be appreciated that the assembly 100 is useful for securely holding and carrying toys of various types, including but not limited to stuffed toys, on the person of a toddler, small child or other wearer. The assembly 100 prevents or minimizes the risk or likelihood that the toy will inadvertently become lost or misplaced, particularly when the wearer leaves home. The assembly 100 can be constructed in various sizes and colors for different sizes and ages of wearers. The chest panel 102, back panel 172, base strap 114, panel strap 134, shoulder straps 150, toy securing straps 160 and other components of the assembly 100 can be fabricated of nylon, polyester, cotton, fabric blends and/or other washable materials. In some embodiments, the chest panel 102 and the back panel 172 may be rendered waterproof or water-resistant and may be mildew resistant.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A toy carrying harness assembly dimensioned to be worn by a child to releasably secure and carry at least one toy thereon, said assembly comprising:

a chest panel having a chest panel top edge, a chest panel bottom edge and oppositely disposed chest panel side edges;

a back panel having a back panel top edge, a back panel bottom edge and oppositely disposed back panel side edges;

at least one base strap disposed in an interconnecting relation between said chest panel and said back panel, said at least one base strap operably securable around the child's midsection;

at least one panel strap interconnected to and extending outwardly from each of said oppositely disposed chest panel side edges;

a pair of shoulder straps each disposed in an interconnecting relation between said at least one panel strap and said back panel, each of said pair of shoulder straps operably positionable over a corresponding one of each of the child's shoulders, respectively; and at least one toy securing strap attached to said chest panel and operable to releasably secure the at least one toy adjacent to said chest panel.

2. The toy carrying harness assembly as recited in claim 1, wherein said at least one base strap includes at least one base strap buckle to facilitate operably securing said at least one base strap around the child's midsection.

3. The toy carrying harness assembly as recited in claim 2, wherein said at least one base strap buckle is disposed proximate one of said oppositely disposed chest panel side edges.

4. The toy carrying harness assembly as recited in claim 2, wherein said at least one base strap buckle comprises a quick-disconnect buckle.

5. The toy carrying harness assembly as recited in claim 1, wherein said at least one panel strap includes at least one panel strap buckle to facilitate operably securing said at least one panel strap around the child's chest.

6. The toy carrying harness assembly as recited in claim 5, wherein said at least one panel strap buckle is disposed proximate one of said oppositely disposed chest panel side edges.

7. The toy carrying harness assembly as recited in claim 5, wherein said at least one panel strap buckle comprises a quick-disconnect buckle.

8. The toy carrying harness assembly as recited in claim 1, wherein at least one of said pair of shoulder straps includes at least one shoulder strap adjuster to facilitate adjustment of a length of said at least one of said pair of shoulder straps.

9. The toy carrying harness assembly as recited in claim 1, wherein each of said pair of shoulder straps includes at least one shoulder strap adjuster to facilitate adjustment of a length of a corresponding one of said pair of shoulder straps.

10. The toy carrying harness assembly as recited in claim 1, wherein said at least one toy securing strap includes at least one toy strap adjuster to facilitate releasably securing the at least one toy adjacent to said chest panel.

11. The toy carrying harness assembly as recited in claim 1, wherein said back panel further comprises a back panel front surface and a back panel rear surface.

12. The toy carrying harness assembly as recited in claim 11, further comprising at least one logo displayed on said back panel rear surface.

13. The toy carrying harness assembly as recited in claim 1, wherein said base strap includes a base tab strap segment and a base receptacle strap segment each interconnected to and extending outwardly from a different one of each of said oppositely disposed back panel side edges.

14. The toy carrying harness assembly as recited in claim 13, further comprising a base strap buckle having a base buckle tab attached to said base tab strap segment and a base buckle receptacle attached to said base receptacle strap segment, said base buckle tab cooperatively structured with said base buckle receptacle to facilitate detachably securing said base tab strap segment and said base receptacle strap segment to one another about the child's midsection.

15. The toy carrying harness assembly as recited in claim 1, wherein said panel strap includes a panel tab strap segment and a panel receptacle strap segment each interconnected to and extending outwardly from a different one of each of said oppositely disposed front panel side edges.

16. The toy carrying harness assembly as recited in claim 15, further comprising a panel strap buckle having a panel buckle tab attached to said panel tab strap segment and a panel buckle receptacle attached to said panel receptacle strap segment, said panel buckle tab cooperatively structured with said panel buckle receptacle to facilitate detachably securing said panel tab strap segment and said panel receptacle strap segment to one another about the child's chest.

17. A toy carrying harness assembly dimensioned to be worn by a child to releasably secure and carry at least one toy thereon, said assembly comprising:

a chest panel having a chest panel top edge, a chest panel bottom edge, oppositely disposed chest panel side edges, a chest panel front surface and a chest panel rear surface;

a back panel having a back panel top edge, a back panel bottom edge, and oppositely disposed back panel side edges;

at least one base strap disposed in an interconnecting relation between said chest panel and said back panel, said at least one base strap includes at least one base strap buckle to facilitate operably securing said at least one base strap around the child's midsection;

at least one panel strap interconnected to and extending outwardly from each of said oppositely disposed chest panel side edges, said at least one panel strap includes at least one panel strap buckle to facilitate operably securing said at least one panel strap around the child's chest;

a pair of shoulder straps each interconnected to said at least one panel strap proximate a different one of said oppositely disposed chest panel side edges and said back panel proximate said back panel top edge, each of said pair of shoulder straps adjustably positionable over a corresponding one of each of the child's shoulders, respectively;

each of said pair of shoulder straps includes at least one shoulder strap adjuster to facilitate adjustment of a length of a corresponding one of said pair of shoulder straps; and a plurality of toy securing straps attached to said chest panel and operable to releasably secure the at least one toy adjacent to said chest panel front surface.

18. The toy carrying harness assembly as recited in claim 17, wherein said chest panel and said back panel are constructed of a water resistant material of construction.

19. The toy carrying harness assembly as recited in claim 17, wherein said assembly is constructed of a mildew resistant material of construction.

20. A toy carrying harness assembly dimensioned to be worn by a child to releasably secure and carry at least one toy thereon, said assembly comprising:

a chest panel having a chest panel top edge, a chest panel bottom edge, oppositely disposed chest panel side edges, a chest panel front surface and a chest panel rear surface;

a back panel having a back panel top edge, a back panel bottom edge, oppositely disposed back panel side edges, a back panel front surface and a back panel rear surface, wherein at least one logo is displayed on said back panel rear surface;

a base strap disposed in an interconnecting relation between said chest panel and said back panel, said base strap including a base tab strap segment and a base receptacle strap segment each interconnected to and extending outwardly from a different one of each of said oppositely disposed back panel side edges;

a base strap buckle having a base buckle tab attached to said base tab strap segment and a base buckle receptacle attached to said base receptacle strap segment, said base buckle tab cooperatively structured with said base buckle receptacle to facilitate detachably securing said base tab strap segment and said base receptacle strap segment to one another about the child's midsection;

a panel strap interconnected to and extending outwardly from each of said oppositely disposed chest panel side edges, said panel strap includes a panel tab strap segment and a panel receptacle strap segment each interconnected to and extending outwardly from a different one of each of said oppositely disposed front panel side edges;

a panel strap buckle having a panel buckle tab attached to said panel tab strap segment and a panel buckle receptacle attached to said panel receptacle strap segment, said panel buckle tab cooperatively structured with said panel buckle receptacle to facilitate detachably securing said panel tab strap segment and said panel receptacle strap segment to one another about the child's chest;

a pair of shoulder straps each interconnected to said at least one panel strap proximate a different one of said oppositely disposed chest panel side edges and said back panel proximate said back panel top edge, each of said pair of shoulder straps adjustably positionable over a corresponding one of each of the child's shoulders, respectively;

each of said pair of shoulder straps includes at least one shoulder strap adjuster to facilitate adjustment of a length of a corresponding one of said pair of shoulder straps; and a plurality of toy securing straps attached to said chest panel and operable to releasably secure the at least one toy adjacent to said chest panel front surface.

* * * * *